US006893803B2

(12) United States Patent
Lee

(10) Patent No.: US 6,893,803 B2
(45) Date of Patent: May 17, 2005

(54) BARRIER RIB OF PLASMA DISPLAY PANEL AND FORMING METHOD THEREOF

(75) Inventor: Yoon Kwan Lee, Gwangmyeong (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/750,929

(22) Filed: Dec. 30, 2003

(65) Prior Publication Data

US 2004/0248048 A1 Dec. 9, 2004

(30) Foreign Application Priority Data

Jun. 4, 2003 (KR) ..... 10-2003-0036025

(51) Int. Cl.[7] ..... H01J 1/00

(52) U.S. Cl. ..... 430/320; 430/321; 430/330; 445/24; 313/582

(58) Field of Search ..... 430/198, 319, 430/320, 321, 330; 445/24; 313/582, 584, 586

(56) References Cited

U.S. PATENT DOCUMENTS 5,909,083 A * 6/1999 Asano et al. ..... 313/584

* cited by examiner

*Primary Examiner*—John A. McPherson
(74) *Attorney, Agent, or Firm*—Lee, Hong, Degerman, Kang & Schmadeka

(57) ABSTRACT

Disclosed is a barrier rib of a plasma display panel and forming method thereof, by which costs for fabricating the barrier rib are reduced and the fabricating method is simplified. The present invention includes forming a white paste layer on a glass substrate and forming a photosensitive black resist layer on the white paste layer, forming a photosensitive black resist pattern by patterning the photosensitive black resist layer, heating the photosensitive black resist pattern so that a wax component contained in the photosensitive black resist pattern diffuses inside the photosensitive black resist pattern, and removing a portion of the white paste layer failing to be covered with the photosensitive black resist pattern and plasticizing the photosensitive black resist pattern and the remaining photosensitive black resist pattern.

17 Claims, 5 Drawing Sheets

BARRIER RIB OF PLASMA DISPLAY PANEL AND FORMING METHOD THEREOF

BACKGROUND OF THE INVENTION

1. Field of the Invention

The present invention relates to a plasma display panel (hereinafter abbreviated PDP), and more particularly, to a barrier rib of a plasma display panel and forming method thereof, by which costs for fabricating the barrier rib are reduced and the fabricating method is simplified.

2. Description of the Background Art

Lately, many efforts are made to study and develop such a next generation digital multimedia display device as LCD (liquid crystal display), FED (field emission display), PDP, ELD (electroluminescent display), etc. Specifically, many attentions are paid to PDP that is more advantageous than others.

The PDP is a display device using light-emission generated from phosphors of R, G, and B excited by a 147 nm UV-ray radiated by (He+Xe) or (Ne+Xe) gas discharge in a discharge cell provided by a barrier rib. The PDP is a large-sized (over 40") screen display device having such many advantages as facilitated fabrication due to simple configuration, high brightness, high efficiency, memory function, high non-linearity, wide viewing angle over 160°, etc.

A barrier rib of a three electrode AC surface discharge type PDP and fabricating method thereof are explained in detail by referring to the attached drawings as follows.

FIG. 1 is a cross-sectional view of a discharge cell of a three electrode AC surface discharge type PDP according to a related art.

Referring to FIG. 1, a discharge cell of the PDP is formed by combining a front plate 100 and a back plate 110 and by injecting discharge gas between the front and back plates 100 and 110.

The front plate 100 consists of an upper glass substrate 101, transparent electrode 102 and bus electrode 103 formed on the upper glass substrate 101, an upper dielectric layer 104 formed on the upper glass substrate 101 including the transparent and bus electrodes 102 and 103 formed thereon, and a protection layer 105 formed on the upper dielectric layer 104 to protect the upper dielectric layer 104 from plasma discharge.

The back plate 110 consists of a lower glass substrate 116, an under layer 115 formed on the lower glass substrate 116 to prevent penetration of alkali ions contained in the lower glass substrate 116, an address electrode 114 formed on the under layer 115, a lower dielectric layer 113 formed on under layer 115 including the address electrode 114, a barrier rib 111 formed on the lower dielectric layer 113 to form a discharge cell, and a phosphor 112 formed on the lower dielectric layer 113 and the barrier rib 111.

In this case, the barrier rib 111 plays an important role in preventing electrical and optical cross talk between discharge cells. The barrier rib 111 is mainly formed of ceramic or glass-ceramic. A width of the barrier rib 111 is 70~100 $\mu$m and a height of the barrier rib 111 is 120~200 $\mu$m. 80% of an overall thickness of the barrier rib 111 is formed of a highly reflective white paste layer 111B containing $TiO_2$ or $Al_2O_3$ as a filling agent and the rest 20% is formed of a black paste layer 111A enabling to absorb external light effectively.

The above-constructed barrier rib 111 is formed by screen printing, sandblasting, or additive method. A method of forming a barrier rib of PDP using sandblasting is explained by referring to the attached drawing.

FIG. 2 is a flowchart of a method of forming a barrier rib of PDP according to a related art.

Referring to FIG. 2, a method of forming a barrier rib of PDP includes the steps of forming a white paste layer and a black paste layer on the glass substrate successively (S21), forming a DFR (dry film resist) layer on the black paste layer (S22), forming a DFR pattern by patterning the DFR layer into a predetermined figure (S23), removing portions of the black and white past layers failing to be covered with the DFP pattern (S24), and removing the DFR pattern and plasticizing the remaining black and white paste layers to form the barrier rib (S25).

A method of forming a barrier rib of PDP according to a related art is explained in detail by referring to FIGS. 3A to 3E as follows.

FIGS. 3A to 3E are cross-sectional views of a method of forming a barrier rib of PDP according to a related art.

Referring to FIG. 3A, each of the white paste layer 310A and the black paste layer 310B is formed on the glass substrate 300 by printing to have a predetermined height (S21). In this case, the glass substrate 300 includes the lower glass substrate 116 on which the under layer 115, address electrode 114, and lower dielectric layer 113 are successively formed.

The white paste layer 310A is formed in a following manner.

First of all, several-tens % of $TiO_2$ or $Al_2O_3$ powder having a particle diameter below 2 $\mu$m for improvement of reflection property and adjustment of dielectric constant is mixed with PbO or non-PbO glass powder having a particle diameter of 1~2 $\mu$m to form mixed powder. The mixed powder is then mixed in an organic solvent to form the white paste 310A of a paste phase having a viscosity of 40,000~50,000 cps.

The black paste layer 310B is formed in a following manner.

First of all, several % of black pigment for absorption of external light is mixed with PbO or non-PbO glass powder having a particle diameter of 1~2 $\mu$m, and is then mixed with several % of $Al_2O_3$ powder having a particle diameter of 2~3 $\mu$m for rigidity maintenance to form the black paste layer 310B of a paste phase having a viscosity of 30,000~4,000 cps on the white paste layer 310A. And, the black paste layer 310B is dried at 100~150° C.

Referring to FIG. 3B, the DFR layer 320 is formed on the black paste layer 310B by laminating (S22).

Referring to FIG. 3C, a mask (not shown in the drawing) is formed on the DFR layer 320. UV-ray exposure and development are carried out on the DFR layer 320 having the mask formed thereon to form the DFR pattern 320A (S23).

Referring to FIG. 3D, portions of the black and white paste layers failing to be covered with the DFR pattern 320A are removed by sandblasting (S24).

Referring to FIG. 3E, the DFR pattern 320A is removed by alkali solution. The remaining black and white paste layers 310B and 310A after sandblasting are dried at 100~150° C. and plasticized to form the barrier rib 310 of the PDP (S25). In this case, the plasticization is carried out at 550~600° C., and density of internal structure of the barrier rib varies according to compositions and contents of the glass and filling agent.

As mentioned in the foregoing explanation of the related art method of forming the barrier rib of the PDP, the barrier rib is formed using the DFR pattern formed on the black paste layer, whereby fabrication costs of the barrier rib of the PDP are increased.

Moreover, when the DFR pattern is removed in the alkali solution, water contents and alkali ions may penetrate into the barrier rib to produce impurity gas in the discharge space. Hence, the related art method of forming the barrier rib of the PDP needs an additional step of drying the water contents at 100~150° C.

SUMMARY OF THE INVENTION

Accordingly, the present invention is directed to a barrier rib of a plasma display panel and forming method thereof that substantially obviates one or more problems due to limitations and disadvantages of the related art.

An object of the present invention is to provide a barrier rib of a plasma display panel and forming method thereof, by which costs for fabricating the barrier rib are reduced by forming the barrier layer using a black resist having a photo-sensitivity property.

Another object of the present invention is to provide a barrier rib of a plasma display panel and forming method thereof, by which the fabricating method is simplified by forming the barrier layer using a black resist having a photo-sensitivity property.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a barrier rib of a plasma display panel according to the present invention includes a white paste layer on a glass substrate and a photosensitive black resist layer on the white paste layer.

In another aspect of the present invention, a method of forming a barrier rib of PDP includes the steps of forming a white paste layer on a glass substrate and forming a photosensitive black resist layer on the white paste layer, forming a photosensitive black resist pattern by patterning the photosensitive black resist layer, heating the photosensitive black resist pattern so that a wax component contained in the photosensitive black resist pattern diffuses inside the photosensitive black resist pattern, and removing a portion of the white paste layer failing to be covered with the photosensitive black resist pattern and plasticizing the photosensitive black resist pattern and the remaining white paste layer.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
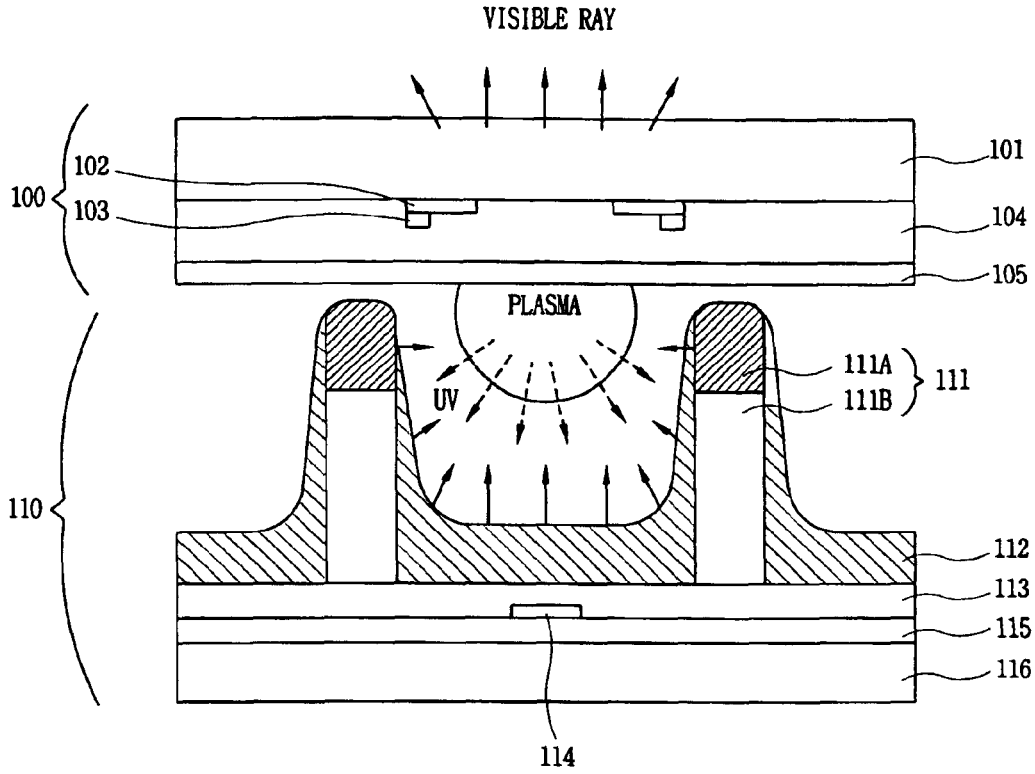
FIG. 1 CONVENTIONAL ART
FIG. 1 is a cross-sectional view of a discharge cell of a three electrode AC surface discharge type PDP according to a related art.
Figure 2:
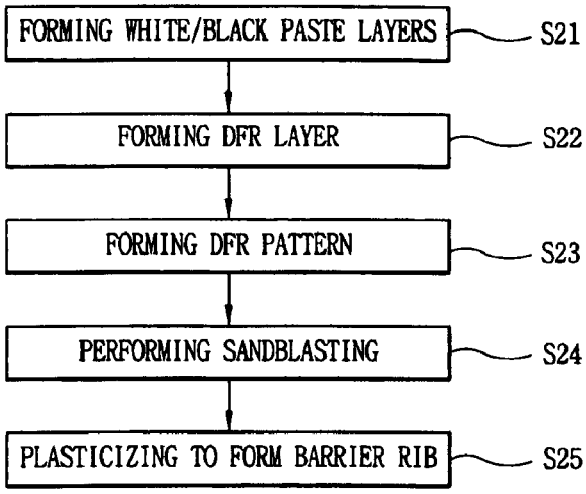
FIG. 2 CONVENTIONAL ART
FIG. 2 is a flowchart of a method of forming a barrier rib of PDP according to a related art.
Figure 3A:
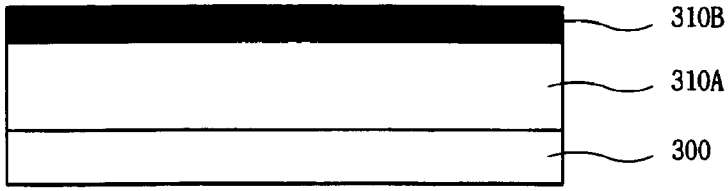
FIG. 3A CONVENTIONAL ART
FIGS. 3A to 3E are cross-sectional views of a method of forming a barrier rib of PDP according to a related art.
Figure 3B:
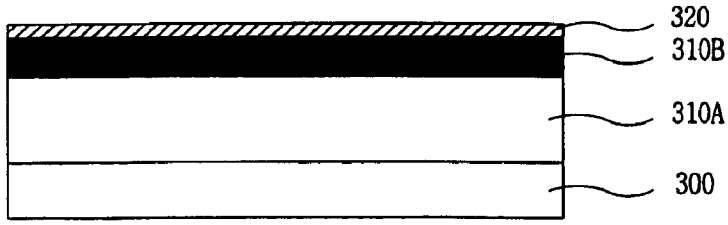
FIG. 3B CONVENTIONAL ART
Figure 3C:
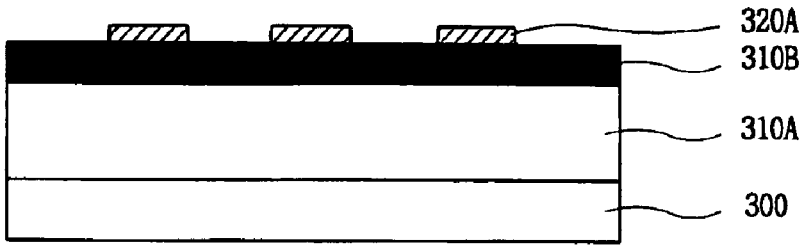
FIG. 3C CONVENTIONAL ART
Figure 3D:
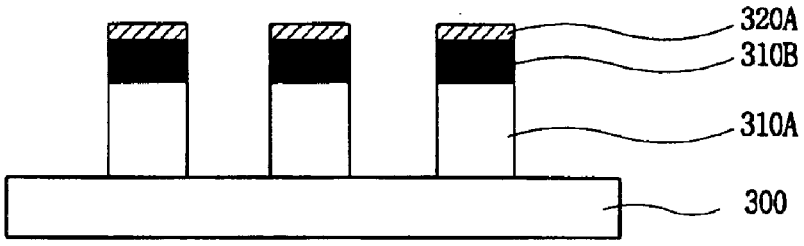
FIG. 3D CONVENTIONAL ART
Figure 3E:
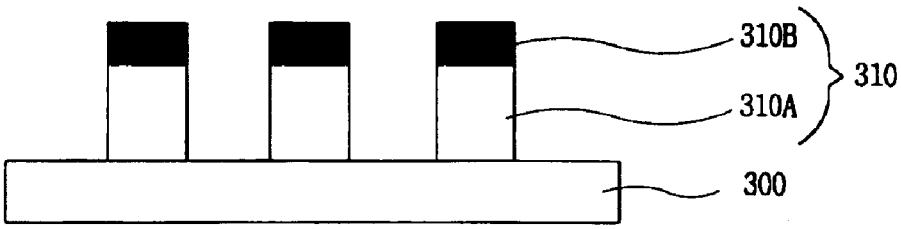
FIG. 3E CONVENTIONAL ART
Figure 4:
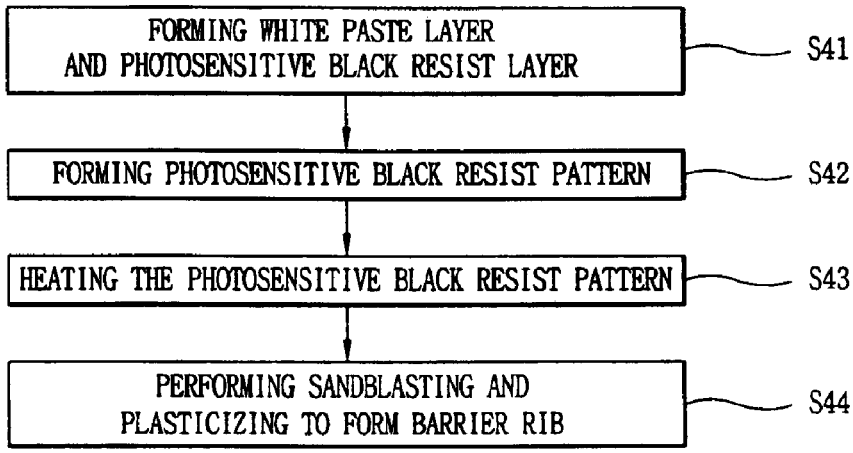
FIG. 4 is a flowchart of a method of forming a barrier rib of PDP according to the present invention.

FIG. 4 is a flowchart of a method of forming a barrier rib of PDP according to the present invention.

Referring to FIG. 4, a method of forming a barrier rib of PDP according to the present invention includes the steps of forming a white paste layer on a glass substrate and forming a photosensitive black resist layer on the white paste layer (S41), forming a photosensitive black resist pattern by patterning the photosensitive black resist layer (S42), heating the photosensitive black resist pattern so that a wax component contained in the photosensitive black resist pattern diffuses inside the photosensitive black resist pattern (S43), and removing a portion of the white paste layer failing to be covered with the photosensitive black resist pattern and plasticizing the photosensitive black resist pattern and the remaining photosensitive black resist pattern to form the barrier rib (S44).

A method of forming a barrier rib of PDP according to the present invention is explained in detail by referring to FIGS. 5A to 5D as follows.

FIGS. 5A to 5D are cross-sectional views of a method of forming a barrier rib of PDP according to the present invention.

Figure 5A:
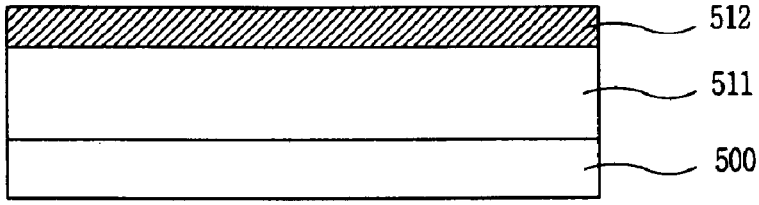
FIGS. 5A to 5D are cross-sectional views of a method of forming a barrier rib of PDP according to the present invention.
Figure 5B:
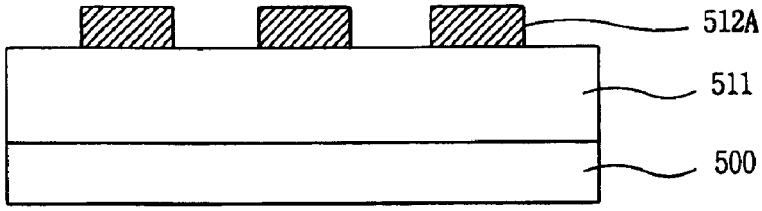

Referring to FIG. 5A, a white paste layer 511 is formed on a glass substrate 500 and a photosensitive black resist layer 512 is formed on the white paste layer 511 (S41). In this case, the glass substrate 500 includes a lower glass substrate on which an under layer, an address electrode, and a lower dielectric layer are successively formed.

The white paste layer 511 is formed in a following manner.

First of all, several-tens % of $TiO_2$ or $Al_2O_3$ powder having a particle diameter below 2 $\mu$m for improvement of reflection property and adjustment of dielectric constant is mixed with PbO or non-PbO glass powder having a particle diameter of 1~2 $\mu$m to form mixed powder. The mixed powder is then mixed in an organic solvent to form the white paste 310A of a paste phase having a viscosity of 40,000~50,000 cps.

The black paste layer 512 is formed in a following manner.

First of all, several % of black pigment for absorption of external light is mixed with PbO or non-PbO glass powder having a particle diameter of 1~2 $\mu$m, and is then mixed with several % of $Al_2O_3$ powder having a particle diameter of 1~2 $\mu$m for rigidity maintenance to form the photosensitive black resist layer 512 of a paste phase having a viscosity of 30,000~4,000 cps.

Moreover, the photosensitive black resist layer 512 is an organic substance including photopolymerizable monomer, photopolymerization initiator, binder polymer, and solvent. In this case, the photopolymerizable monomer is PETA (pentaerythritol tetraacrylate) or TMPEOTA (trimethylolpropane ethoxy triacrylate). The photopolymerization initiator is one of HSP 188, Irgacur 651, Irgacur 184, and Darocur 1173. The binder polymer is one of PVB (polyvinyl butyral) and a mixture of methyl methacrylate and methacrylic acid. Preferably, the solvent is one of TX (texanol), BC (butyl carbital), and BCA (butyl carbitol acetate).

Besides, several-tens % of paraffin wax is added to the photosensitive black resist layer 512 to provide resistance against sandblasting.

Referring to 5B, a mask (not shown in the drawing) is formed on the photosensitive black resist layer 512. UV-ray exposure and development are carried out on the photosensitive black resist layer 512 having the mask formed thereon to form a photosensitive black resist pattern 512A (S42).

Figure 5C:
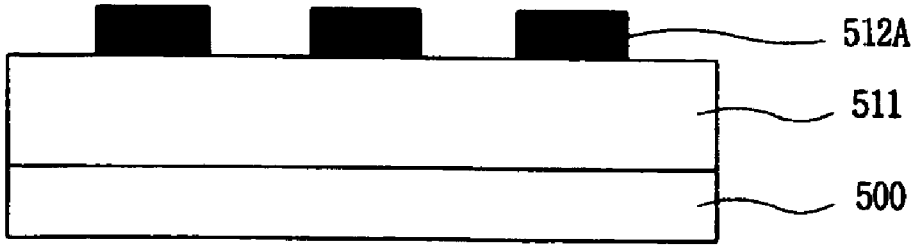

Referring to FIG. 5C, the photosensitive black resist layer 512A is heated at 100~200° C. for about 30 minutes so that the wax component included in the photosensitive black resist-layer 512A sufficiently diffuses inside the photosensitive black resist layer 512A (S43). In this case, the heating step provides the photosensitive black resist layer 512A with resistance against sandblasting to prevent from being damaged by sandblasting.

Figure 5D:
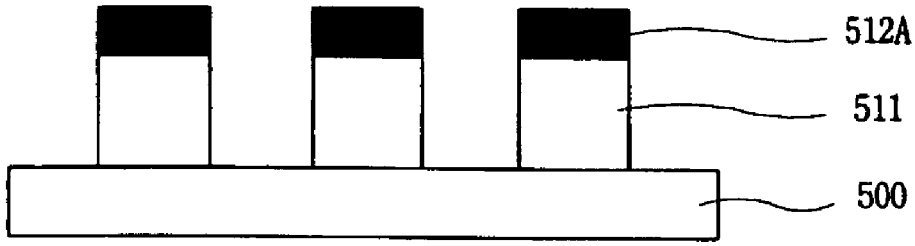

Referring to FIG. 5D, portions of the white paste layer failing to be covered with the photosensitive black resist layer 512A are removed by sandblasting. And, the photosensitive black resist layer 512A and the remaining white paste layer 511 are plasticized to form the barrier rib 510 of the PDP (S44). In this case, the plasticization is carried out at 550~600° C., and density of internal structure of the barrier rib varies according to compositions and contents of the glass and filling agent.

Accordingly, the method of forming the barrier rib of the plasma display panel according to the present invention needs no steps of coating and removing expensive DFR, thereby reducing costs for forming the barrier rib by forming the barrier layer using the black resist having a photosensitivity property.

And, the method of forming the barrier rib of the plasma display panel according to the present invention needs no steps of coating and removing expensive DFR, thereby being simplified by forming the barrier layer using the black resist having a photo-sensitivity property.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A barrier rib of a plasma display panel, comprising:

a white paste layer formed on a glass substrate; and a photosensitive black resist layer formed on the white paste layer wherein the photosensitive black resist layer comprises paraffin wax diffusable in the photorisist black resist layer when heated.

2. The barrier rib of claim 1, wherein the glass substrate comprises a lower glass substrate having an under layer, an address electrode, and a lower dielectric layer stacked thereon successively.

3. The barrier rib of claim 1, wherein the white paste layer and the photosensitive black resist layer are formed to have uniform heights, respectively by printing.

4. The barrier rib of claim 1, wherein the photosensitive black resist layer is formed of an inorganic material and comprises PbO or non-PbO glass powder, black pigment, and $Al_2O_3$ powder.

5. The barrier rib of claim 4, wherein the PbO or non-PbO glass powder and $Al_2O_3$ powder have a particle diameter of 1~2 $\mu$m.

6. The barrier rib of claim 1, wherein the photosensitive black resist layer is formed of a paste phase having a viscosity of 30,000~40,000 cps.

7. The barrier rib of claim 1, wherein the photosensitive black resist layer is formed of an organic material and comprises photopolymerizable monomer, photopolymerization initiator, binder polymer, and solvent.

8. The barrier rib of claim 1, wherein the paraffin wax provides the photosensitive black resist layer with resistance against sandblasting.

9. A method of forming a barrier rib of PDP, comprising the steps of:

forming a white paste layer on a glass substrate and forming a photosensitive black resist layer on the white paste layer, wherein the photosensitive black resist layer comprises paraffin wax;

forming a photosensitive black resist pattern by patterning the photosensitive black resist layer;

heating the photosensitive black resist pattern so that a wax component contained in the photosensitive black resist pattern diffuses inside the photosensitive black resist pattern; and removing a portion of the white paste layer failing to be covered with the photosensitive black resist pattern and plasticizing the photosensitive black resist pattern and the remaining white paste layer.

10. The method of claim 9, wherein the glass substrate comprises a lower glass substrate having an under layer, an address electrode, and a lower dielectric layer stacked thereon successively.

11. The method of claim 9, wherein the white paste layer and the photosensitive black resist layer are formed to have uniform heights, respectively by printing.

12. The method of claim 9, wherein the photosensitive black resist layer is formed of an inorganic material and comprises PbO or non-PbO glass powder having a particle diameter of 1~2 $\mu$m, black pigment, and $Al_2O_3$ powder having a particle diameter of 1~2 $\mu$m.

13. The method of claim 9, wherein the photosensitive black resist layer is formed of a paste phase having a viscosity of 30,000~40,000 cps.

14. The method of claim 9, wherein the photosensitive black resist layer is formed of an organic material and comprises photopolymerizable monomer, photopolymerization initiator, binder polymer, and solvent.

15. The method of claim 9, wherein the paraffin wax provides the photosensitive black resist layer with resistance against sandblasting.

16. The method of claim 9, wherein the portion of the white paste layer failing to be covered with the photosensitive black resist pattern is removed by sandblasting.

17. The method of claim 9, wherein the heating step is performed at 100~200° C. for 30 minutes.

* * * * *